United States Patent [19]

Scott et al.

[11] 4,258,291

[45] Mar. 24, 1981

[54] SMOKE ALARM ACTIVATED PORTABLE LAMP

[75] Inventors: Robert J. Scott, 68A Lake Tapawingo, Blue Springs, Mo. 64015; Bryant F. Craig, Richardson, Tex.

[73] Assignee: Robert J. Scott, Blue Springs, Mo.

[21] Appl. No.: 956,585

[22] Filed: Nov. 1, 1978

[51] Int. Cl.[2] ..... H05B 37/02

[52] U.S. Cl. ..... 315/156; 307/117; 315/159; 340/148; 340/326; 340/628

[58] Field of Search ..... 315/156, 158, 159, 362; 307/117; 325/392; 200/60, 61.01, DIG. 20; 362/802; 340/148, 326, 371, 628

[56] References Cited

U.S. PATENT DOCUMENTS

| | | | |
|---|---|---|---|
| 2,608,614 | 8/1952 | Williams | 340/326 |
| 2,931,020 | 3/1960 | Bender | 340/148 |
| 3,286,126 | 11/1966 | Crawford | 315/159 |
| 3,440,347 | 4/1969 | Spencer et al. | 307/117 X |
| 3,582,671 | 6/1971 | Ott | 340/148 X |
| 3,893,081 | 7/1975 | Hopkins | 340/148 |
| 4,001,805 | 1/1977 | Golbe | 340/545 |

FOREIGN PATENT DOCUMENTS

| | | | |
|---|---|---|---|
| 1159964 | 7/1969 | United Kingdom | 340/148 |

*Primary Examiner*—Eugene R. LaRoche

*Attorney, Agent, or Firm*—Fishburn, Gold and Litman

[57] ABSTRACT

A smoke alarm activated portable light or lamp for providing emergency illumination in response to an alarm signal from a smoke alarm device includes a frequency selective microphone, several amplifier stages, a peak detector, an isolation or buffer stage, and a power stage comprising a pair of cascaded transistors and a light bulb. The lamp includes a bracket for positioning same in proximity to a smoke alarm and a switch which is closed upon removal of the lamp from the bracket. A power saving circuit includes a photoelectric cell and an amplifier and is operative to saturate or overdrive the first gain stage to override any signal from the microphone whereby the lamp is rendered unresponsive to the smoke alarm signal upon illumination of the photocell by daylight or artificial light.

10 Claims, 5 Drawing Figures

SMOKE ALARM ACTIVATED PORTABLE LAMP

The present invention relates to emergency illumination devices and more particularly to a portable flashlight or lamp which illuminates in response to the audible signal of a smoke alarm device.

Smoke alarm devices have been developed particularly for use in households in order to alert the occupants to take emergency action in the earliest stages in the development of a fire. It is generally recommended by fire safety experts that a building in which a developing fire is suspected be immediately evacuated in an orderly manner. In the daytime, there is generally no problem. However, if the occupants of a building are aroused from sleep by an alarm from a smoke detector, there is likely to be confusion and possible panic in attempting to escape from the building. Further, injuries from obstacles unseen in the darkness are a possibility as the occupants move about in attempting to find light switches and evacuate the building.

The portable lamp of the present invention has been developed to provide illumination whereby evacuation from a burning building at night is made more safe. The lamp is illuminated in response to the audible alarm signal of a smoke detector. The lamp further includes a circuit responsive to ambient illumination to render the lamp unresponsive to a smoke alarm during daytime in order to conserve battery power.

The principal objects of the present invention are: to provide a portable lamp for emergency illumination which is activated in response to the sound emitted by a smoke alarm device; to provide such a lamp which is rendered inoperative during illumination thereof by daylight or artificial light; to provide such a lamp which is self-contained and portable; to provide such a device which employs complimentary metal-oxide semiconductor devices for low power consumption during the monitoring of a smoke alarm; to provide such a lamp including a quick release mounting bracket for positioning the lamp for activation in response to a smoke alarm device; to provide such a lamp including a switch which is closed whenever the lamp is removed from the mounting bracket to bypass the circuitry of the lamp whereby the lamp remains on upon removal from the bracket; and to provide such a portable lamp which is economical to manufacture, durable in use, positive in operation, and which is particularly well adapted for its intended purpose.

Other objects and advantages of the present invention will become apparent from the following description taken in connection with the accompanying drawings wherein are set forth, by way of illustration and example, certain embodiments of this invention.

The drawings constitute a part of the specification, include an exemplary embodiment of the present invention, and illustrate various objects and features of the smoke alarm activated portable lamp.

Figure 1:
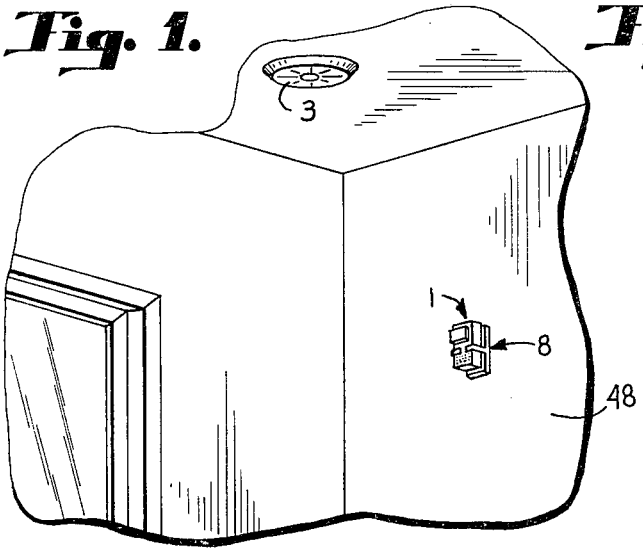
FIG. 1 is a perspective view showing the smoke alarm activated light or lamp positioned in proximity to a smoke alarm device.
Figure 3:
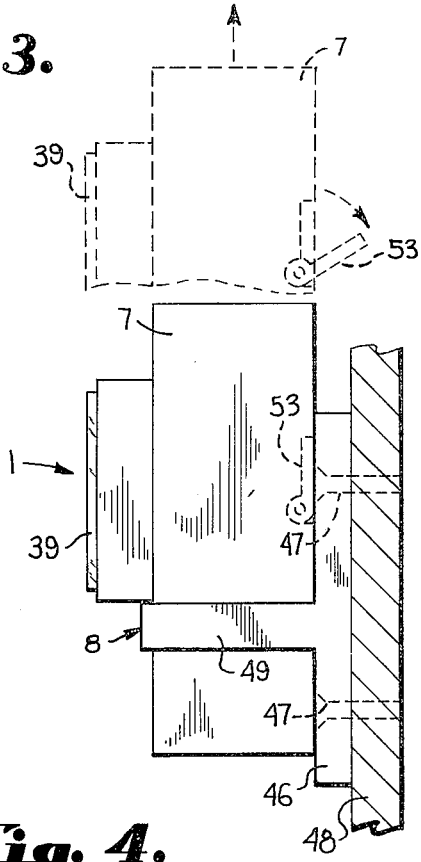
FIG. 3 is a side elevational view of the lamp positioned in a mounting bracket attached to a wall and showing the lamp removed from the bracket in broken lines with a bypass switch operator shown in extended position.
Figure 2:
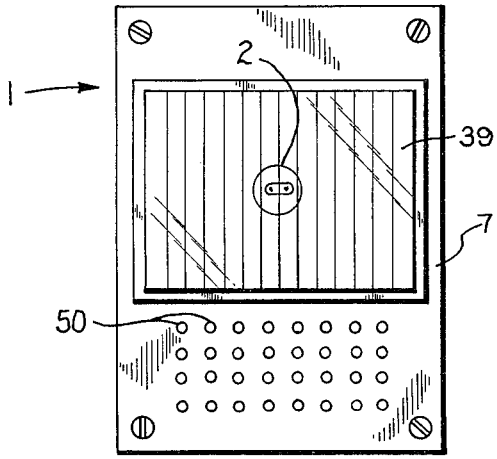
FIG. 2 is a front elevational view of the lamp.
Figure 4:
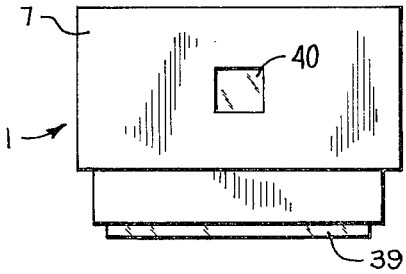
FIG. 4 is a top plan view of the lamp showing a window for reception of light by the photocell of the light activated power saving circuit.
Figure 5:
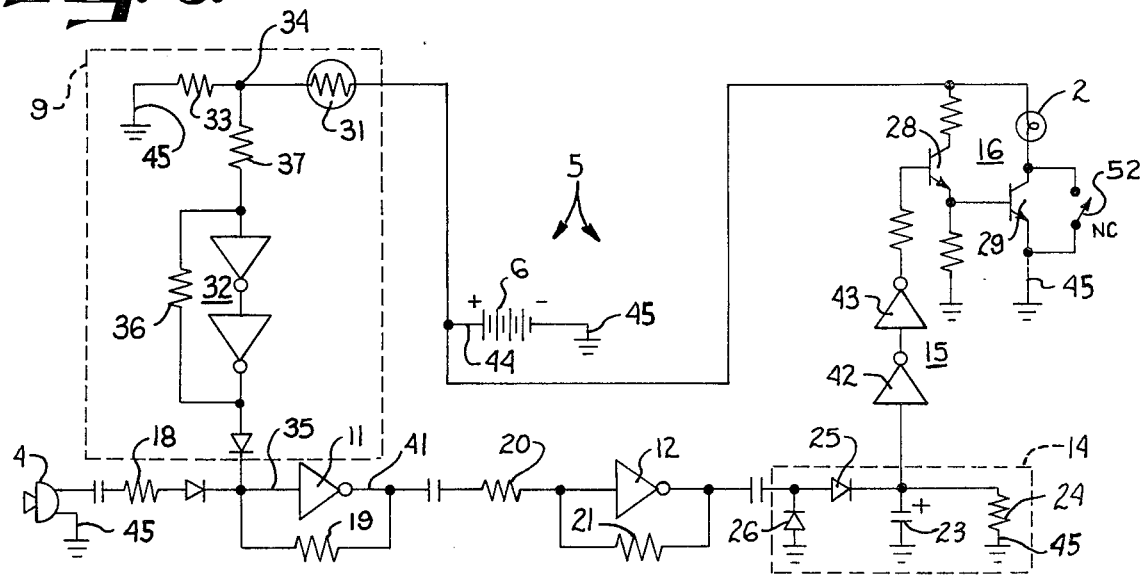
FIG. 5 is a schematic diagram showing the monitoring and switching circuit of the lamp and including the light activated power saving circuit thereof.

Referring to the drawings in more detail:

The reference numeral 1 generally designates a portable sound activated emergency lamp for illuminating a light bulb 2 in response to the sound of the smoke alarm device to provide light for evacuation of a building at night in response to the alarm. The lamp 1 includes a microphone 4 and sound activated circuit means 5 responsive to the sound signal of the smoke alarm 3 to illuminate the light bulb by conduction of power from the battery 6. The bulb, microphone, circuit means, and battery are mounted in a housing 7 which is positionable in a bracket 8 in spaced relation to the alarm device 3. The lamp 1 includes a light activated switch means or circuit 9 which is operative to disable the sound circuit 5, rendering same unresponsive to the alarm signal during daytime or whenever general illumination is available so that the lamp does not respond to sounds similar to the alarm signal, resulting in consumption of power from the battery 6.

During the occurrence of an alarm signal from the smoke alarm 3, the microphone 4 provides an electrical signal which is amplified by gain stages 11 and 12. The output of amplifier 12 is applied to a peak detector circuit 14 which provides a steady DC signal having a level equal to the peak level of the signal from the amplifier 12. An isolation or buffer stage 15 receives the steady signal from the peak detector 14 and provides isolation between the amplifier stages 11 and 12 and the power amplifier circuit 16.

The microphone 4 is preferably a frequency selective microphone and, in the preferred embodiment, has a peak response from 2.6 to 3.4 kilohertz which includes the alarm signal frequencies of most commercially available smoke alarm devices. Alternatively, a wide range microphone could be employed with a suitable bandpass filter. The power amplifier 16 is operated in a switching mode whereby current is conducted through the light bulb 2 in response to an input signal of sufficient level. The respective gains of the amplifiers 11 and 12 are set in order to provide an input signal of sufficient level for the power amplifier 16. The gain of amplifier 11 is set by proper choice of the input resistor 18 and the feedback resistor 19. Similarly, the gain of amplifier 12 is set by resistors 20 and 21.

The peak detector 14 includes a capacitor 23, a resistor 24, and a pair of diodes 25 and 26 and is operative to track the input thereto to a peak value, that is, charge up to a peak value and hold the charge for a time period determined by the time constant of the capacitor and resistor in combination. In the illustrated circuit, the capacitor 23 has a value of 25 microfarads, while the resistor 24 has a value of 100 kilohms. Therefore, the combination of capacitor 23 and resistor 24 has a relatively long time constant, which not only determines discharge time but also charge-up time. The long time constant of peak detector 14 requires that an alarm signal entering microphone 4 have a minimum duration in order to effect illumination of the light bulb 2, thus providing a delay between the initiation of an alarm and illumination of the bulb 2. This delay prevents false actuation of the circuit 5 in response to sound sources having the proper frequency range to enter same, but not a long enough duration. The diode 25 prevents undesired discharge of the capacitor 23, as does the buffer stage 15 which has a high input impedance.

The power amplifier 16 may take any suitable form, and in the illustrated embodiment, comprises a driver transistor 28 and a power transistor 29. The power amplifier 16 is conventional in operation, the driver transistor being turned on by an input signal of sufficient level and the power transistor 29 being turned on by the driver transistor 28. In the on-state, the power transistor 29 completes a circuit from the battery 6 through the light bulb 2, thereby illuminating same.

The light activated switch or power saving circuit 9 includes a photocell 31 and an amplifier 32. The photocell 31 may be any type of circuit element having properties which are altered in proportion to the level of illumination. In the illustrated light activated switch, the photocell 31 is a photoconductive cell having a high resistance in the absence of illumination and a lowered resistance in response to the illumination thereof. The photocell 31 is connected in a voltage divider network with another resistor 33. Current flows through the voltage divider as a result of connection across the battery 6. The "dark" or quiescent voltage of a junction 34 between the photocell 31 and resistor 33 is raised upon illumination of the photocell 31. The change in voltage from a quiescent voltage to an activated voltage of the junction is amplified by the amplifier 32 which is connected to an input 35 of the amplifier 11. The gain of amplifier 32 is determined by the relative values of a feedback resistor 36 and an input resistor 37 thereto. The output signal from the amplifier 32 is operative to disable the circuit 5 by overriding any possible electrical signals from the microphone 4. The purpose for disabling the circuit 5, as has been mentioned, is to render the lamp 1 unresponsive to either the alarm signal from the smoke alarm 3 or other sound signals during daytime or whenever general lighting is available, in order to conserve the power of the battery 6.

Since the photocell 31 is responsive to many forms of illumination including that of the light bulb 2, it is necessary to isolate the photocell 31 from the effects of the light bulb 2 in order to prevent undesired feedback. If the photocell 31 were not isolated from the light bulb 2, triggering of the circuit 5 would result in oscillation within the circuit characterized by blinking of the light bulb at a rate determined by the elements within the circuit. In order to isolate the photocell 31 from the effects of the light bulb 2, the light bulb 2 is mounted in a reflector arrangement 39, and the photocell 31 is mounted behind a window 40 on the housing 7 preferably facing in a direction not susceptible to illumination by the light bulb 2.

In order to provide sufficient battery power for illumination in response to alarm signal after long unattended periods of time, the circuit 5 is constructed using low power drain components. For this purpose, the amplifiers 11, 12, 15 and 32 constructed using complimentary metal-oxide semiconductor (CMOS) inverters. Six such inverters are available on a type 74C04 integrated circuit package which is available from several manufacturers. These inverters are logic inverter circuits and are characterized by extremely low power consumption and very high input impedance. The amplifiers 11 and 12 each contain a single inverter while the buffer 15 and amplifier 32 include a pair of the inverters. In the buffer 15 the high input impedance of inverter 42 prevents discharge of capacitor 23 therethrough and, in accordance with inverter 43, applies the voltage level on the capacitor 23 to the input of the power amplifier circuit 16.

During illumination of the photocell 31, the amplifier 32 is operative to apply substantially the battery voltage to the input 35 of amplifier 11. This disable signal drives the amplifier 11 into a saturated condition such that the electrical signal from the microphone 4, being of a substantially lower level than the disable signal, is effectively overridden and is thereby prevented from being further amplified and applied to the peak detector 14. Since the amplifier 11 is an inverter, when the input 35 is at a maximum, the output 41 thereof is at a minimum, which is substantially at the potential of the ground 45 of the circuit 5. Therefore, the amplifier 12 and inverters 42 and 43 remain in a cut-off condition, and in either a cut-off or saturated condition the CMOS inverters draw only minute leakage currents. During the disabled condition, the current drawn from the battery is in the microamp range; therefore, the circuit 5 is a very efficient monitoring circuit. It is to be understood that each of the inverters includes connection to the positive side of 44 of the battery and the negative side or ground 45 thereof.

The sound activated portable lamp 1 is positioned in proximity to a smoke alarm device 3 for monitoring. Manufacturer's instructions for use of the device would include specific recommendations concerning spacing from the smoke detector 3 for proper operation. The bracket 8 includes a base 46 having apertures therethrough to receive fasteners 47 for attachment of the bracket to a wall 48. Projecting from the base 46 are means 49 forming a cradle to receive the lamp 1 in monitoring position therein. The cradle forming means 49 must be arranged in such a manner so that openings 50 in the housing 7 for admission of sound to the microphone 4 are not covered.

After the lamp 1 has been illuminated by the sound signal of a smoke alarm 3, it is desirable for the light to remain on for safe evacuation from the building. Therefore, the circuit 5 includes a normally closed bypass switch 52 connected across the power transistor 29 and providing an alternate path for current through the light bulb 2 in a closed condition of a switch. The switch 52 includes a switch operator 53 mounted on the housing 7 in such a manner that the operator 53 opens the switch 52 in a retracted position of the operator. The switch operator 53 is held in a retracted position by contact with the base 46 of the bracket 8 when the housing 7 is placed in the bracket. Upon removal of the lamp 1 from the bracket, the switch operator extends thereby allowing the switch 52 to close. Therefore, upon illumination of the lamp 1, in response to an alarm signal, the housing may be removed from the bracket 8 and the lamp will remain illuminated for safe evacuation of the building. The switch and switch operator, 52 and 53, may be provided in any suitable form.

In summary, the bracket 8 is attached to a wall 48 in proximity to a smoke alarm device 3 according to the manufacturer's recommendations. The lamp 1 is placed in the bracket whereby the switch operator is caused to retract thereby opening the switch 52 and placing the circuit 5 in a monitoring condition. During daytime or whenever other general light is available, the photocell 31 is illuminated thereby disabling the circuit 5, in order to conserve the power of the battery 6. Upon the occurrence of a sound signal from the smoke alarm 3 during the absence of ambient illumination, the light bulb 2 is illuminated to provide light for safe evacuation of the building. The lamp 1 is removed from the bracket 3 thereby allowing the switch operator 53 to extend and close the switch 52 such that the lamp 1 remains turned on so that the evacuees may get out of the building and avoid obstacles in doing so. The lamp 1 may include a switch (not shown) for selectively disconnecting battery 6.

It is to be understood that while certain forms of the present invention have been described and illustrated, it is not to be limited thereto except insofar as such limitations are included in the following claims.

What is claimed and desired to secure by Letters Patent is:

1. A portable lamp activated by the sound signal of a smoke alarm comprising:

(a) a frequency selective microphone;

(b) a light bulb;

(c) a battery;

(d) circuit means interconnecting said microphone, light bulb, and battery and responsive to the sound signal of a smoke alarm device to effect illumination of said light bulb;

(e) a portable housing with said microphone, light bulb, battery, and circuit means mounted thereon; and (f) light activated switch means connected to said circuit means and rendering said circuit means unresponsive to said sound signal during illumination of said light activated switch means to thereby conserve battery power.

2. A lamp as set forth in claim 1 including: a bracket removably retaining said lamp in spaced relation to an audible smoke alarm device.

3. A lamp as set forth in claim 2 including:

(a) a normally closed (NC) switch connected to said circuit means and bypassing same to effect illumination of said light bulb in a closed condition of said NC switch; and (b) said NC switch being held in an open condition by positioning said housing in said bracket.

4. A lamp as set forth in claim 1 wherein said light activated switch means includes:

(a) light activated switch amplifier means operatively connected to said circuit means;

(b) a photoelectric cell operatively connected to said amplifier means;

(c) said amplifier means having substantially no output signal in the absence of illumination of said photoelectric cell; and (d) said amplifier means having a disable signal at an output thereof in response to sufficient illumination of said photoelectric cell, said disable signal rendering said circuit means unresponsive to said sound signal.

5. A lamp as set forth in claim 4 wherein said circuit means includes microphone amplifier means having said microphone connected to an input thereof, said microphone providing a microphone signal to said microphone amplifier means in response to said sound signal and wherein:

(a) said light activated switch means is connected to said input of said microphone amplifier means; and (b) said disable signal is operative to drive said microphone amplifier means into a saturated condition whereby said microphone signal is overridden and said circuit means is thereby rendered unresponsive to said sound signal during illumination of said photoelectric cell.

6. A lamp as set forth in claim 1 wherein said light activated switch means includes:

(a) a photoconductive cell;

(b) a voltage divider network having said photoconductive cell connected therein, said network having current flow therethrough;

(c) said network including a junction having a quiescent voltage in the absence of illumination of said photoconductive cell and having an activated voltage in response to illumination of said photoconductive cell;

(d) light activated switch amplifier means having said junction connected to an input thereof and said circuit means connected to an output thereof;

(e) said amplifier means having substantially no output signal in response to said quiescent voltage; and (f) said amplifier means having a disable signal at the output thereof in response to said activated voltage, said disable signal rendering said circuit means unresponsive to said sound signal during illumination of said photoconductive cell.

7. A lamp as set forth in claim 1 wherein said circuit means includes a plurality of extremely low power consumption logic inverter circuits.

8. In a sound activated illumination device including: sound activated illumination circuit means; a light bulb connected to and illuminated by said circuit means upon activation of same in response to a selected sound signal; and a portable housing enclosing said circuit means and bulb, the improvement comprising:

(a) a battery enclosed in said housing, connected to said circuit means and said bulb, and providing operating power for said device;

(b) light activated switch means connected to said circuit means and rendering said circuit means unresponsive to said sound signal during illumination of said light activated switch means to conserve the power of said battery;

(c) a bracket removably mounting said device in spaced relation to a smoke alarm device for activation by a sound signal from said smoke alarm device;

(d) a normally closed (NC) switch connected to said circuit means and bypassing same to effect illumination of said light bulb in a closed condition of said NC switch; and (e) said NC switch being held in an open condition by positioning said housing in said bracket.

9. A device as set forth in claim 8 wherein said light activated switch means includes:

(a) light activated switch amplifier means having an output connected to said circuit means;

(b) a photoelectric cell operatively connected to said amplifier means;

(c) said amplifier means having substantially no output signal in the absence of illumination of said photoelectric cell; and (d) said amplifier means having a disable signal at an output thereof in response to sufficient illumination of said photoelectric cell, said disable signal rendering said circuit means unresponsive to said sound signal.

10. A device as set forth in claim 8 wherein said circuit means includes a microphone connected to an input of a microphone amplifier means, said microphone providing a microphone signal to said microphone amplifier means in response to said sound signal, and wherein said light activated switch means includes:

(a) a photoelectric cell;

(b) a voltage divider network having said photoelectric cell connected therein, said network having current flow therethrough and having a junction;

(c) said junction having a quiescent voltage in the absence of illumination of said photoelectric cell and having an activated voltage in response to illumination of said photoelectric cell;

(d) light activated switch amplifier means having an input connected to said junction and an output operatively connected to said microphone amplifier means input; and (e) said light activated switch amplifier means having substantially no output signal in response to said quiescent voltage and having a disable signal being operative to drive said microphone amplifier means into a saturated condition whereby said microphone signal is overridden and said circuit means is thereby rendered unresponsive to said sound signal during illumination of said photoelectric cell.

* * * * *